US005864650A

United States Patent [19]

Taniguchi et al.

[11] Patent Number: 5,864,650

[45] Date of Patent: Jan. 26, 1999

[54] SPEECH ENCODING METHOD AND APPARATUS USING TREE-STRUCTURE DELTA CODE BOOK

[75] Inventors: Tomohiko Taniguchi; Yoshinori Tanaka; Yasuji Ohta; Hideaki Kurihara, all of Kawasaki, Japan

[73] Assignee: Fujitsu Limited, Kawasaki, Japan

[21] Appl. No.: 762,694

[22] Filed: Dec. 12, 1996

Related U.S. Application Data

[63] Continuation of Ser. No. 244,068, filed as PCT/JP93/01323, Sep. 16, 1993 published as WO94/07239, Mar. 31, 1994, abandoned.

[30] Foreign Application Priority Data

Sep. 16, 1992 [JP] Japan ..... 4-246491

[51] Int. Cl.[6] ..... G10L 3/02

[52] U.S. Cl. ..... 395/2.29; 395/2.25; 395/2.32

[58] Field of Search ..... 395/2.25–2.34, 395/2.71–2.73

[56] References Cited

U.S. PATENT DOCUMENTS 5,323,486 6/1994 Taniguchi et al. ..... 395/2.29

5,359,696 10/1994 Gerson et al. ..... 395/2.32

FOREIGN PATENT DOCUMENTS

| | | |
|---|---|---|
| 59-012499 | 1/1984 | Japan . |
| 61-184928 | 8/1986 | Japan . |
| 2-055400 | 2/1990 | Japan . |
| 4-039679 | 6/1992 | Japan . |
| 4-344699 | 12/1992 | Japan . |
| 4-352200 | 12/1992 | Japan . |
| 5-088698 | 4/1993 | Japan . |
| 5-158500 | 6/1993 | Japan . |
| 5-210399 | 8/1993 | Japan . |
| 5-232996 | 9/1993 | Japan . |

*Primary Examiner*—Kee M. Tung
*Attorney, Agent, or Firm*—Staas & Halsey

[57] ABSTRACT

A larger number, L', of delta vectors $\Delta_i$ (i=0, 1, 2, . . . , L'−1) than the required number L are each multiplied by a matrix of a linear predictive synthesis filter (3), their power $(A\Delta_i)^T(A\Delta_i)$ is evaluated (42), and the delta vectors are reordered in decreasing order of power (43); then, L delta vectors are selected in decreasing order of power, the largest power first, to construct a tree-structure data code book (41), using which A-b-S vector quantization is performed (48). This provides increased freedom for the space formed by the delta vectors and improves quantization characteristics. Further, variable rate encoding is achieved by taking advantage of the structure of the tree-structure data code book.

18 Claims, 8 Drawing Sheets y
x
z
$e_y$
$e_x$
X
$e_z$
$\Delta_0 = e_x$, $\Delta_1 = e_y$, $\Delta_2 = e_z$ y
x
z
$A(e_y)$
$A(e_x)$
$A(X)$
$A(e_z)$
$|A(e_z)|^2 > |A(e_x)|^2 > |A(e_y)|^2$ (1) $\Delta_0 = e_x$, $\Delta_1 = e_y$
(OR $\Delta_0 = e_y$, $\Delta_1 = e_x$)

(2) $\Delta_0 = e_x$, $\Delta_1 = e_z$ (3) $\Delta_0 = e_y$, $\Delta_1 = e_z$

SPEECH ENCODING METHOD AND APPARATUS USING TREE-STRUCTURE DELTA CODE BOOK

This application is a continuation of application Ser. No. 08/244,068, filed as PCT/JP93/01323, Sep. 16, 1993 published as WO94/07239, Mar. 31, 1994 now abandoned.

TECHNICAL FIELD

The present invention relates to a speech encoding method and apparatus for compressing speech signal information, and more particularly to a speech encoding method and apparatus based on Analysis-by-Synthesis (A-b-S) vector quantization for encoding speech at transfer rates of 4 to 16 kbps.

BACKGROUND ART

In recent years, a speech encoder based on A-b-S vector quantization, such as a code-excited linear prediction (CELP) encoder, has been drawing attention in the fields of LAN systems, digital mobile radio systems, etc., as a promising speech encoder capable of compressing speech signal information without degrading its quality. In such a vector quantization speech encoder (hereinafter simply called the encoder), predictive weighting is applied to each code vector in a code book to reproduce a signal, and an error power between the reproduced signal and the input speech signal is evaluated to determine a number (index) for a code vector with the smallest error prior to transmission to the receiving end.

The encoder based on such an A-b-S vector quantization system performs linear predictive filtering on each of the speech source signal vectors according to about 1,000 patterns stored in the code book, and searches the about 1,000 patterns for the one pattern that minimizes the error between a reproduced signal and the input speech signal to be encoded.

Since the encoder is required to ensure the instantaneousness of voice communication, the above search process must be performed in real time. This means that the search process must be performed repeatedly at very short time intervals, for example, at 5 ms intervals, for the duration of voice communication.

However, as will be described in detail, the search process involves complex mathematical operations, such as filtering and correlation calculations, and the amount of calculation required for these mathematical operations will be enormous, for example, in the order of hundreds of mega-operations per second (Mops). To handle such operations, a number of chips will be required even if the fastest digital signal processors (DSPs) currently available are used. In portable telephone applications, for example, this will present a problem as it will make it difficult to reduce the equipment size and power consumption.

To overcome the above problem, the present applicant proposed, in Japanese Patent Application No. 3-127669 (Japanese Patent Unexamined Publication No. 4-352200), a speech encoding system using a tree-structure code book wherein instead of storing code vectors themselves as in previous systems, a code book, in which delta vectors representing differences between signal vectors are stored, is used, and these delta vectors are sequentially added and subtracted to generate code vectors according to a tree structure.

According to this system, the memory capacity required to store the code book can be reduced drastically; furthermore, since the filtering and correlation calculations, which were previously performed on each code vector, are performed on the delta vectors and the results are sequentially added and subtracted, a drastic reduction in the amount of calculation can be achieved.

In this system, however, the code vectors are generated as a linear combination of a small number of delta vectors that serve as fundamental vectors; therefore, the generated code vectors do not have components other than the delta vector components. More specifically, in a space where the vectors to be encoded are distributed (usually, 40- to 64-dimensional space), the code vectors can only be mapped in a subspace having a dimension corresponding at most to the number of delta vectors (usually, 8 to 10).

Accordingly, the tree-structure delta code book has had the problem that the quantization characteristic degrades as compared with the conventional code book free from structural constraints even if the fundamental vectors (delta vectors) are well designed on the basis of the statistic distribution of the speech signal to be encoded.

Noting that when the linear predictive filtering operation is performed on each code vector to evaluate the distance, amplification is not achieved uniformly for all vector components but is achieved with a certain bias, and that the contribution each delta vector makes to code vectors in the tree-structure delta code book can be changed by changing the order of the delta vectors, the present applicant proposed, in Japanese Patent Application No. 3-515016, a method of improving the characteristic by using a tree-structure code book wherein each time the coefficient of the linear predictive filter is determined, a filtering operation is performed on each delta vector and the resulting power (the length of the vector) is compared, as a result of which the delta vectors are reordered in order of decreasing power.

However, with this method also, code vectors are generated from a limited number of delta vectors, as with the previous method, so that there is a limit to improving the characteristic. A further improvement in the characteristic is therefore demanded.

Another challenge for the speech encoder based on A-b-S vector quantization is to realize variable bit rate encoding. Variable bit rate encoding is an encoding scheme capable of varying the bit rate such that the encoding bit rate is adaptively varied according to situations such as the remaining capacity of the transmission path, significance of the speech source, etc., to achieve a greater encoding efficiency as a whole.

If the vector quantization system is to be applied to variable bit rate voice encoding, it is necessary to prepare code books each containing patterns corresponding to each transmission rate, and perform encoding by switching the code book according to the desired transmission rate.

In the case of conventional code books each constructed from a simple arrangement of code vectors, N×M words of memory corresponding to the product of the vector dimension (N) and the number of patterns (M) would be necessary to store each code book. Since the number of patterns M is proportional to the n-th power of 2 where n is the bit length of an index of the code vector, the problem is that an enormous amount of memory will be required in order to increase the variable range of the transmission rate or to control the transmission rate in smaller increments.

Also, in variable bit rate transmission, there are cases in which the rate of the transmission signals has to be reduced according to a request from the transmission network side even after encoding. In such cases, the decoder has to reproduce the speech signal from bit-dropped information, i.e. information with some bits dropped from the encoded information generated by the encoder.

For scalar quantization, which is inferior in efficiency to vector quantization, various techniques have so far been devised to cope with bit drop situations, for example, by performing control so that bits are dropped from the LSB side in increasing order of significance, or by constructing a high bit rate quantizer in such a manner as to contain the quantization levels of a low bit rate quantizer (embedded encoding).

However, in the case of the vector quantization system that uses conventional code books constructed from a simple arrangement of code vectors, since no structuring schemes are employed in the construction of the code books, there are no differences in significance among index bits for a code vector (whether the dropped bit is the LSB or MSB, the result will be the same in that an entirely different vector is called), and the same techniques as employed for scalar quantization cannot be used. The resulting problem is that a bit drop situation will cause a significant degradation in sound quality.

DISCLOSURE OF THE INVENTION

Accordingly, it is a first object of the invention to provide a speech encoding method and apparatus that use a tree-structure data code book achieving a further improvement on the above-described system.

It is another object of the invention to provide a speech encoding method and apparatus employing vector quantization which do not require an enormous amount of memory for the code book and are capable of coping with bit drop situations.

According to the present invention, there is provided a speech encoding method by which an input speech signal vector is encoded using an index assigned to a code vector that, among premapped code vectors, is closest in distance to the input speech signal vector, comprising the steps of:

a) storing a plurality of differential code vectors:

b) multiplying each of the differential code vectors by a matrix of a linear predictive synthesis filter;

c) evaluating the power amplification ratio of each differential code vector multiplied by the matrix;

d) reordering the differential code vectors, each multiplied by the matrix, in decreasing order of the evaluated power amplification ratio;

e) selecting from among the reordered vectors a prescribed number of vectors in decreasing order of the evaluated power amplification ratio, the largest ratio first;

f) evaluating the distance between the input speech signal vector and each of linear-predictive- synthesis-filtered code vectors formed by sequentially adding and subtracting the selected vectors through a tree structure; and g) determining the code vector for which the evaluated distance is the smallest.

According to the present invention, there is also provided a speech encoding apparatus by which an input speech signal vector is encoded using an index assigned to a code vector that, among premapped code vectors, is closest in distance to the input speech signal vector, comprising:

means for storing a plurality of differential code vectors:

means for multiplying each of the differential code vectors by a matrix of a linear predictive synthesis filter;

means for evaluating the power amplification ratio of each differential code vector multiplied by the matrix;

means for reordering the differential code vectors, each multiplied by the matrix, in decreasing order of the evaluated power amplification ratio;

means for selecting from among the reordered vectors a prescribed number of vectors in decreasing order of the evaluated power amplification ratio, the largest ratio first;

means for evaluating the distance between the input speech signal vector and each of linear-predictive-synthesis-filtered code vectors formed by sequentially adding and subtracting the selected vectors through a tree structure; and means for determining the code vector for which the evaluated distance is the smallest.

According to the present invention, there is also provided a variable-length speech encoding method by which an input speech signal vector is variable-length encoded using a variable-length code assigned to a code vector that, among premapped code vectors, is closest in distance to the input speech signal vector, comprising the steps of:

a) storing a plurality of differential code vectors:

b) evaluating the distance between the input speech signal vector and each of code vectors formed by sequentially performing additions and subtractions, working from the root of a tree structure, on the number of differential code vectors corresponding to a desired code length;

c) determining a code vector for which the evaluated distance is the smallest; and d) determining a code, of the desired code length, to be assigned to the thus determined code vector.

According to the present invention, there is also provided a variable-length speech encoding apparatus by which an input speech signal vector is variable-length encoded using a variable-length code assigned to a code vector that, among premapped code vectors, is closest in distance to the input speech signal vector, comprising:

means for storing a plurality of differential code vectors:

means for evaluating the distance between the input speech signal vector and each of code vectors formed by sequentially performing additions and subtractions, working from the root of a tree structure, on the number of differential code vectors corresponding to a desired code length;

means for determining a code vector for which the evaluated distance is the smallest; and means for determining a code, of the desired code length, to be assigned to the thus determined code vector.

BEST MODE FOR CARRYING OUT THE INVENTION

Figure 1:
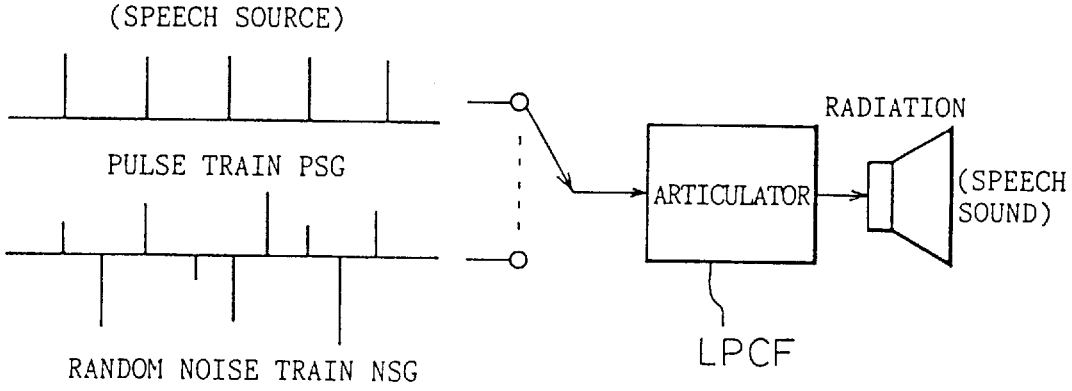
Fig.1 PRIOR ART
FIG. 1 is a block diagram illustrating the concept of a speech sound generating system.

There are two types of speech sound, voiced and unvoiced sounds. Voiced sounds are generated by a pulse sound source caused by vocal chord vibration. The characteristic of the vocal tract, such as the throat and mouth, of each individual speaker is appended to the pulse sounds to thereby form speech sounds. Unvoiced sounds are generated without vibrating the vocal chords, the sound source being a Gaussian noise train which is forced through the vocal tract to thereby form speech sounds. Therefore, the speech sound generating mechanism can be modelled by using, as shown in FIG. 1, a pulse sound generator PSG that generates voiced sounds, a noise sound generator NSG that generates unvoiced sounds, and a linear predictive coding filter LPCF that appends the vocal tract characteristic to signals output from the respective generators. Human voice has pitch periodicity which corresponds to the period of the pulse train output from the pulse sound generator and which varies depending on each individual speaker and the way he or she speaks.

From the above, it can be shown that if the period of the pulse sound generator and the noise train of the noise generator that correspond to input speech sound can be determined, the input speech sound can be encoded by using the pulse period and code data (index) by which the noise train of the noise generator is identified.

Figure 2:
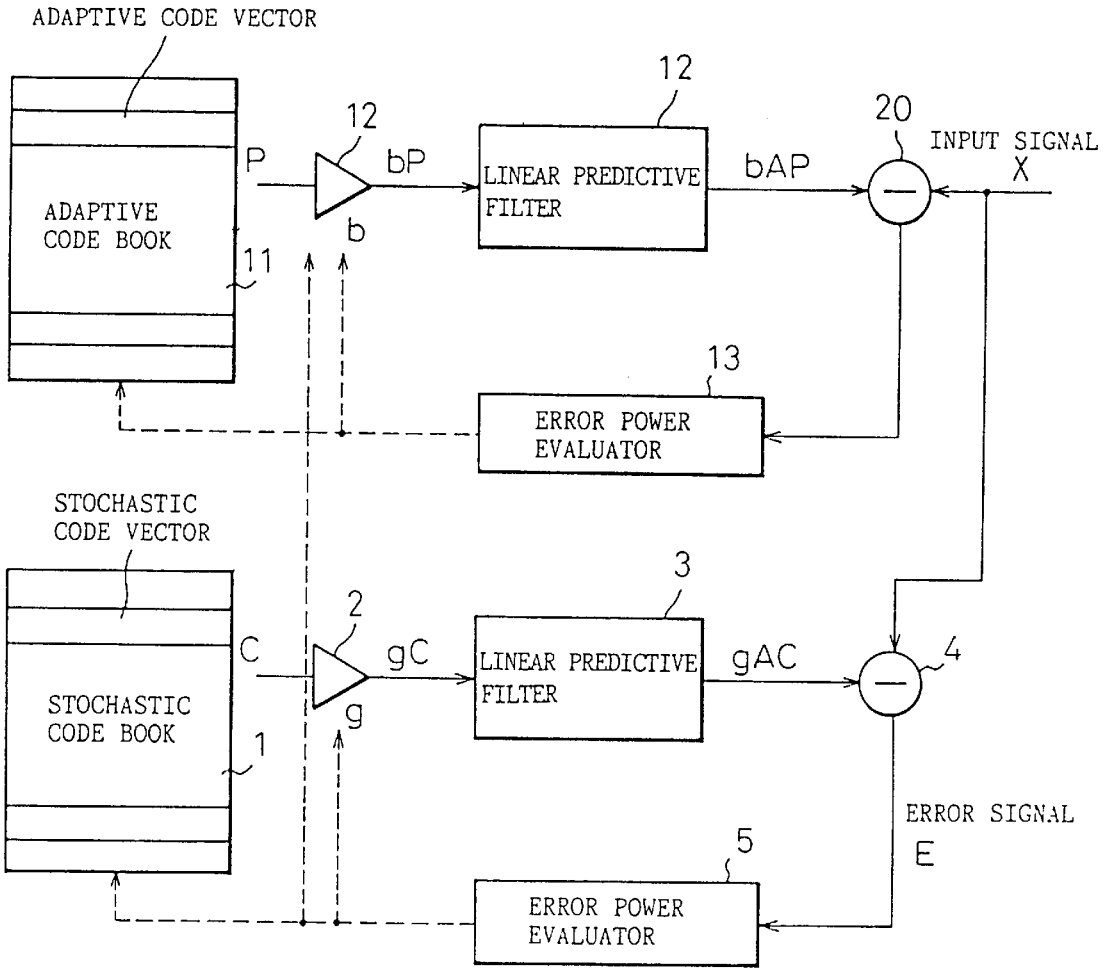
Fig. 2 PRIOR ART
FIG. 2 is a block diagram illustrating the principle of a typical CELP speech encoding system.

Here, as shown in FIG. 2, vectors P obtained by delaying a past value (bP+gC) by different numbers of samples are stored in an adaptive code book 11, and a vector bP, obtained by multiplying each vector P from the adaptive code book 11 by a gain b, is input to a linear predictive filter 12 for filtering; then, the result of the filtering, bAP, is subtracted from the input speech signal X, and the resulting error signal is fed to an error power evaluator 13 which then selects from the adaptive code book 11 a vector P that minimizes the error power and thereby determines the period.

After that, or concurrently with the above operation, each code vector C from a stochastic code book 1, in which a plurality of noise trains (each represented by an N-dimensional vector) are prestored, is multiplied by a gain g, and the result is input to a linear predictive filter 3 for processing; then, a code vector that minimizes the error between the reconstructed signal vector gAC output from the linear predictive synthesis filter 3 and the input signal vector X (an N-dimensional vector) is determined by an error power evaluator 5. In this manner, the speech sound can be encoded by using the period and the data (index) that specifies the code vector. The above description given with reference to FIG. 2 has specifically dealt with an example in which the vectors AC and AP are orthogonal to each other; in other cases than the illustrated example, a code vector is determined which minimizes the error relative to a vector X—bAP representing the difference between the input signal vector X and the vector bAP.

Figure 3:
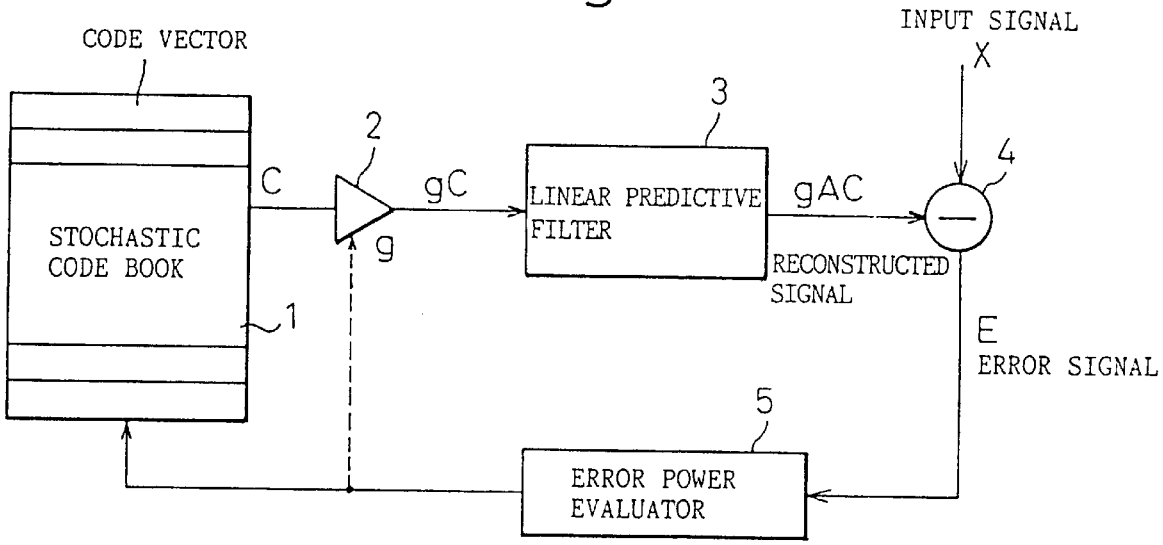
Fig. 3 PRIOR ART
FIG. 3 is a block diagram showing the configuration of a stochastic code book search process in A-b-S vector quantization according to the prior art.

FIG. 3 shows the configuration of a speech transmission (encoding) system that uses A-b-S vector quantization. The configuration shown corresponds to the lower half of FIG. 2. More specifically, 1 is a stochastic code book that stores N-dimensional code vectors C up to size M, 2 is an amplifier of gain g, 3 is a linear predictive filter that has a coefficient determined by a linear predictive analysis based on the input signal X and that performs linear predictive filtering on the output of the amplifier 2, 4 is an error generator that outputs an error in the reproduced signal vector output from the linear predictive filter 3 relative to the input signal vector, and 5 is an error power evaluator that evaluates the error and obtains a code vector that minimizes the error.

In this A-b-S quantization, unlike conventional vector quantization, each code vector (C) from the stochastic code book 1 is first multiplied by the optimum gain (g), and then filtered through the linear predictive filter 3, and the resulting reproduced signal vector (gAC) is fed into the error generator 4 which generates an error signal (E) representing the error relative to the input signal vector (X); then, using the power of the error signal as an evaluation function (a distance measure), the error power evaluator 5 searches the stochastic code book 1 for a code vector that minimizes the error power. Using the code (index) that specifies the thus obtained code vector, the input signal is encoded for transmission.

The error power at this time is given by $$|E|^2=|X-gAC|^2 \tag{1}$$

The optimum code vector and gain g are so determined as to minimize the error power shown by Equation (1). Since the power varies with the sound level of the voice, the power of the reproduced signal is matched to the power of the input signal by optimizing the gain g. The optimum gain can be obtained by partially differentiating Equation (1) with respect to g.

$$d|E|^2/dg=0$$

g is given by $$g=(X^TAC)/((AC)^T(AC)) \tag{2}$$

Substituting g into Equation (1)

$$|E|^2=|^-X|^2-(X^TAC)^2/((AC)^T(AC)) \tag{3}$$

When the cross-correlation between the input signal X and the output AC of the linear predictive filter 3 is denoted by $R_{XC}$, and the autocorrelation of the output AC of the linear predictive filter 3 is denoted by $R_{CC}$, then the cross-correlation and autocorrelation are respectively expressed as $$R_{XC}=X^TAC \tag{4}$$

$$R_{CC}=(AC)^T(AC) \tag{5}$$

Since the code vector C that minimizes the error power given by Equation (3) maximizes the second term on the right-hand side of Equation (3), the code vector C can be expressed as $$C=\text{argmax}\ (R_{XC}^2/R_{CC}) \tag{6}$$

Using the cross-correlation and autocorrelation that satisfy Equation (6), the optimum gain, from Equation (2), is given by $$g=R_{XC}/R_{CC} \tag{7}$$

Figure 4:
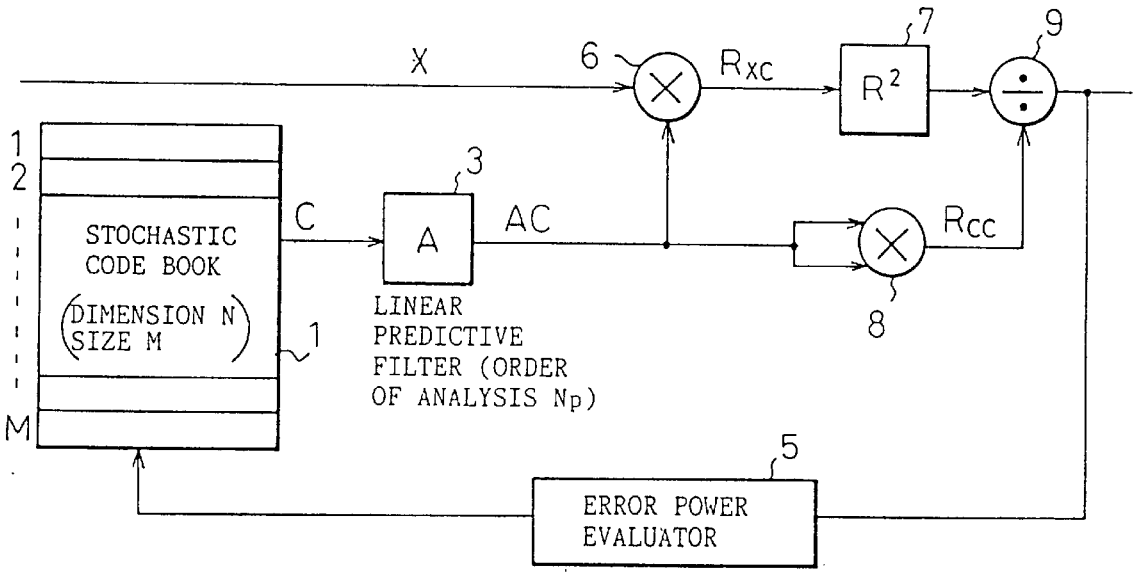
Fig. 4 PRIOR ART
FIG. 4 is a block diagram illustrating a model implementing an algorithm for the stochastic code book search process.

FIG. 4 is a block diagram illustrating a model implementing an algorithm for searching the stochastic code book for a code vector that minimizes the error power from the above equations, and encoding the input signal on the basis of the obtained code vector. The model shown comprises a calculator 6 for calculating the cross-correlation $R_{XC}$ ($=X^TAC$), a calculator 7 for calculating the square of the cross-correlation $R_{XC}$, a calculator 8 for calculating the autocorrelation $R_{CC}$ of AC, a calculator 9 for calculating $R_{XC}^2/R_{CC}$, and an error power evaluator 5 for determining the code vector that maximizes $R_{XC}^2/R_{CC}$, or in other words, minimizes the error power, and outputting a code that specifies the code vector. The configuration is functionally equivalent to that shown in FIG. 3.

The above-described conventional code book search algorithm performs three basic functions, (1) the filtering of the code vector C, (2) the calculation of the cross-correlation $R_{XC}$, and (3) the calculation of the autocorrelation $R_{CC}$. When the order of the LPC filter 3 is denoted by Np, and the order of vector quantization (code vector) by N, the calculation amounts required in (1), (2), and (3) for each code vector are Np·N, N, and N, respectively. Therefore, the calculation amount required for the code book search for one code vector is (Np+2)·N.

A commonly used stochastic code book 1 has a dimension of about 40 and a size of about 1024 (N=40, M=1024), and the order of analysis of the LPC filter 3 is usually about 10. Therefore, the number of addition and multiplication operations required for one code book search amounts to $$(10+2)\cdot 40\cdot 1024=480\times 10^3$$

If such a code book search is to be performed for every subframe (5 msec) of speech encoding, it will require a processing capacity as large as 96 megaoperations per second (Mops); to realize realtime processing, it will require a number of chips even if the fastest digital signal processors (with maximum allowable computational capacity of 20 to 40 Mops) currently available are used.

Furthermore, for storing and retaining such a stochastic code book 1 as a table, a memory capacity of N·M (=40·1024=40K words) will be required.

In particular, in the field of car telephones and portable telephones where the speech encoder based on A-b-S vector quantization has potential use, smaller equipment size and lower power consumption are essential conditions, and the enormous amount of calculation and large memory capacity requirements described above present a serious problem in implementing the speech encoder.

Figure 5:
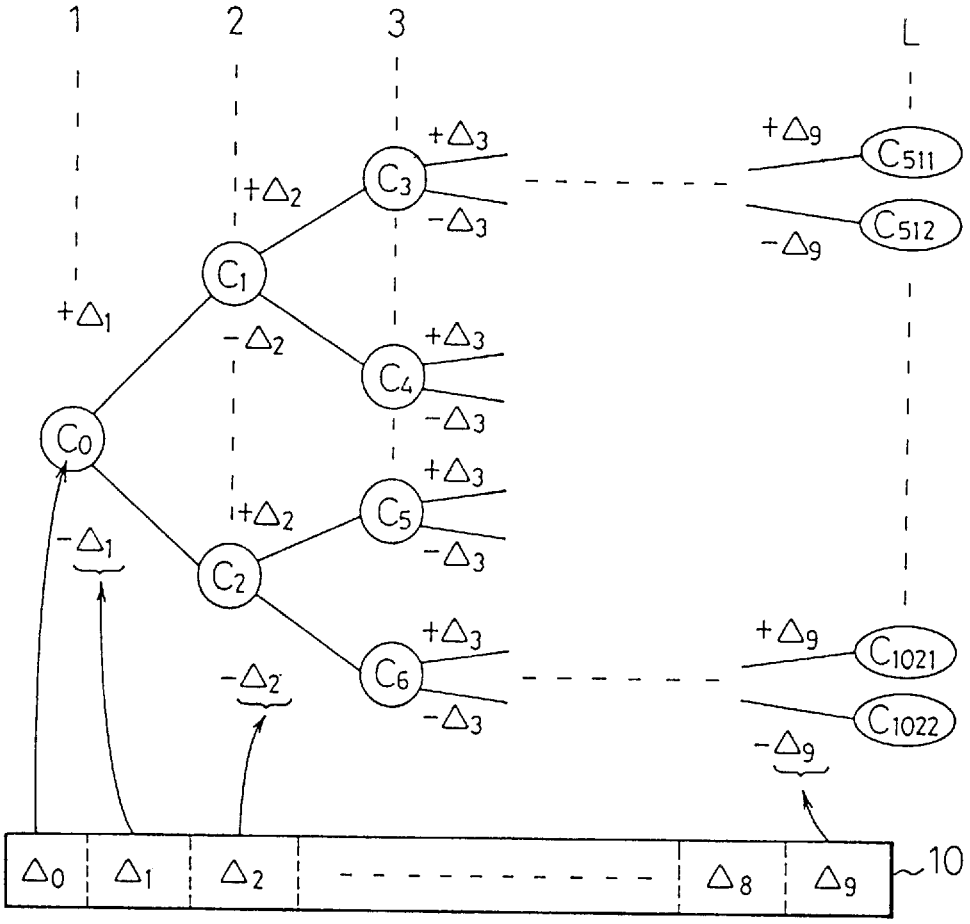
Fig. 5 PRIOR ART
FIG. 5 is a block diagram for explaining a principle of the delta code book.

In view of the above situation, the present applicant proposed, in Japanese Patent Application No. 3-127669 (Japanese Patent Unexamined Publication No. 4-352200), the use of a tree-structure delta code book, as shown in FIG. 5, in place of the conventional stochastic code book, to realize a speech encoding method capable of reducing the amount of calculation required for stochastic code book searching and also the memory capacity required for storing the stochastic code book.

Referring to FIG. 5, an initial vector $C_0$ ($=\Delta_0$), representing one reference noise train, and delta vectors $\Delta_1$ to $\Delta_{L-1}$ (L=10), representing (L−1) kinds (levels) of delta noise trains, are prestored in a delta code book 10, and the respective delta vectors $\Delta_1$ to $\Delta_{L-1}$ are added to and subtracted from the initial vector $C_0$ at each level through a tree structure, thereby forming code vectors (codewords) $C_0$ to $C_{1022}$ capable of representing $(2^{10}-1)$ kinds of noise trains in the tree structure. Or, a $-C_0$ vector (or a zero vector) is added to these vectors to form code vectors (code words) $C_0$ to $C_{1023}$ representing $2^{10}$ noise trains.

In this manner, from the initial vector $\Delta_0$ and the (L−1) kinds of delta vectors, $\Delta_1$ to $\Delta_{L-1}$ (L=10), stored in the delta code book 10, $2^L-1$ ($=2^{10}-1=M-1$) kinds of code vectors or $2^L$ ($=2^{10}=M$) kinds of code vectors can be sequentially generated, and the memory capacity of the delta code book 10 can be reduced to L−N (=10·N), thus achieving a drastic reduction compared with the memory capacity M·N (=1024·N) required for the conventional noise code book.

Using the tree-structure delta code book 10 of such configuration, the cross-correlations $R_{XC}^{(j)}$ and autocorrelations $R_{CC}^{(j)}$ for code vectors $C_j$ (j=0 to 1022 or 1023) can be expressed by the following recurrence relations. That is, when each vector is expressed as $$C_{2k+1}=C_k+\Delta_i \quad i=1, 2, \ldots L-1 \tag{8}$$

or $$C_{2k+2}=C_k-\Delta_i \quad 2^{i-1}-1\leq k<2^i-1 \tag{9}$$

then $$R_{XC}^{(2k+1)}=R_{XC}^{(k)}+X^T(A\Delta_i) \tag{10}$$

or $$R_{XC}^{(2k+2)}=R_{XC}^{(k)}+X^T(A\Delta_i) \tag{11}$$

and $$R_{CC}^{(2k+1)}=R_{CC}^{(k)}+(A\Delta_i)^T(A\Delta_i)+2(A\Delta_i)^T(AC_k) \tag{12}$$

or $$R_{CC}^{(2k+2)}=R_{CC}^{(k)}+(A\Delta_i)^T(A\Delta_i)-2(A\Delta_i)^T(AC_k) \tag{13}$$

Thus, for the cross-correlation $R_{XC}$, when the cross-correlation $X^{T(A\Delta}{}_i)$ is calculated for each delta vector $\Delta_i$ (i=0 to L−1; $\Delta_0=C_0$), the cross-correlations $R_{XC}^{(j)}$ for all code vectors $C_j$ are instantaneously calculated by sequentially adding or subtracting $X^T(A\Delta_i)$ in accordance with the recurrence relation (10) or (11), i.e. through the tree structure shown in FIG. 5. In the case of the conventional code book, a number of addition and multiplication operations amounting to $$M\cdot N\ (=1024\cdot N)$$

was required to calculate the cross-correlations for code vectors for all noise trains. By contrast, in the case of the tree-structure code book, the cross-correlation $R_{XC}^{(j)}$ is not calculated directly from each code vector $C_j$ (j=0, 1, . . . $2^L-1$), but calculated by first calculating the cross-correlation relative to each delta vector $\Delta_j$ (j=0, 1, . . . L−1) and then adding or subtracting the results sequentially. Therefore, the number of addition and multiplication operations can be reduced to $$L\cdot N\ (=10\cdot N)$$

thus achieving a drastic reduction in the number of operations.

For the orthogonal term $(A\Delta_i)^T(AC_k)$ in the third term of Equation (12), (13), when $C_k$ is expressed as $$C_k=\Delta_0\pm\Delta_1\pm\Delta_2 \ldots \pm\Delta_{i-1}$$

then $$(A\Delta_i)^T(AC_k)=(A\Delta_i)^T(A\Delta_0)\pm(A\Delta_i)^T(A\Delta_i)\pm \ldots (A\Delta_i)^T(A\Delta_{i-1}) \quad (14)$$

Therefor, by calculating the cross-correlations, $(A\Delta_i)^T(A\Delta_{0,1,2}, \ldots, i_{-1})$, between $\Delta_i$ and $\Delta_0$, $\Delta_1 \ldots A_{i-1}$, and sequentially adding or subtracting the results in accordance with the tree structure of FIG. 5, the third term is calculated. Further, by calculating the autocorrelation, $(A\Delta_i)^T(A\Delta_i)$, of each delta vector $\Delta_i$ in the second term, and sequentially adding or subtracting the results in accordance with Equation (12) or (13), i.e., through the tree structure of FIG. 5, the autocorrelations $R_{CC}^{(j)}$ of all code vectors $C_j$ are instantaneously calculated.

In the case of the conventional code book, the number of addition and multiplication operations amounting to $$M\cdot N\ (=1024\cdot N)$$

was required to calculate the autocorrelations. By contrast, in the case of the tree-structure code book, the autocorrelation $R_{CC}^{(j)}$ is not calculated directly from each code vector $C_j$ (j=0, 1, . . . $2^L-1$), but calculated from the autocorrelation of each delta vector $\Delta_j$ (j=0, 1, . . . $L-1$) and cross-correlations in all possible combinations of different delta vectors. Therefore, the number of addition and multiplication operations can be reduced to $$L(L+1)\cdot N/2\ (=55\cdot N)$$

thus achieving a drastic reduction in the number of operations.

However, since codewords (code vectors) in such a tree-structure delta code book are all formed as a linear combination of delta vectors, the code vectors do not have components other than delta vector components. More specifically, in a space where the vectors to be encoded are distributed (usually, 40- to 64-dimensional space), the code vectors can only be mapped in a subspace having a dimension corresponding at most to the number of delta vectors (usually, 8 to 10).

Accordingly, the tree-structure delta code book has had the problem that the quantization characteristic degrades as compared with the conventional code book free from structural constraints even if the fundamental vectors (delta vectors) are well designed on the basis of the statistic distribution of the speech signal to be encoded.

On the other hand, as previously described, the CELP speech encoder, for which the present invention is intended, performs vector quantization which, unlike conventional vector quantization, involves determining the optimum vector by evaluating distance in a signal vector space containing code vectors processed through a linear predictive filter having a filter transfer function Az.

Figures 6A, 6B:
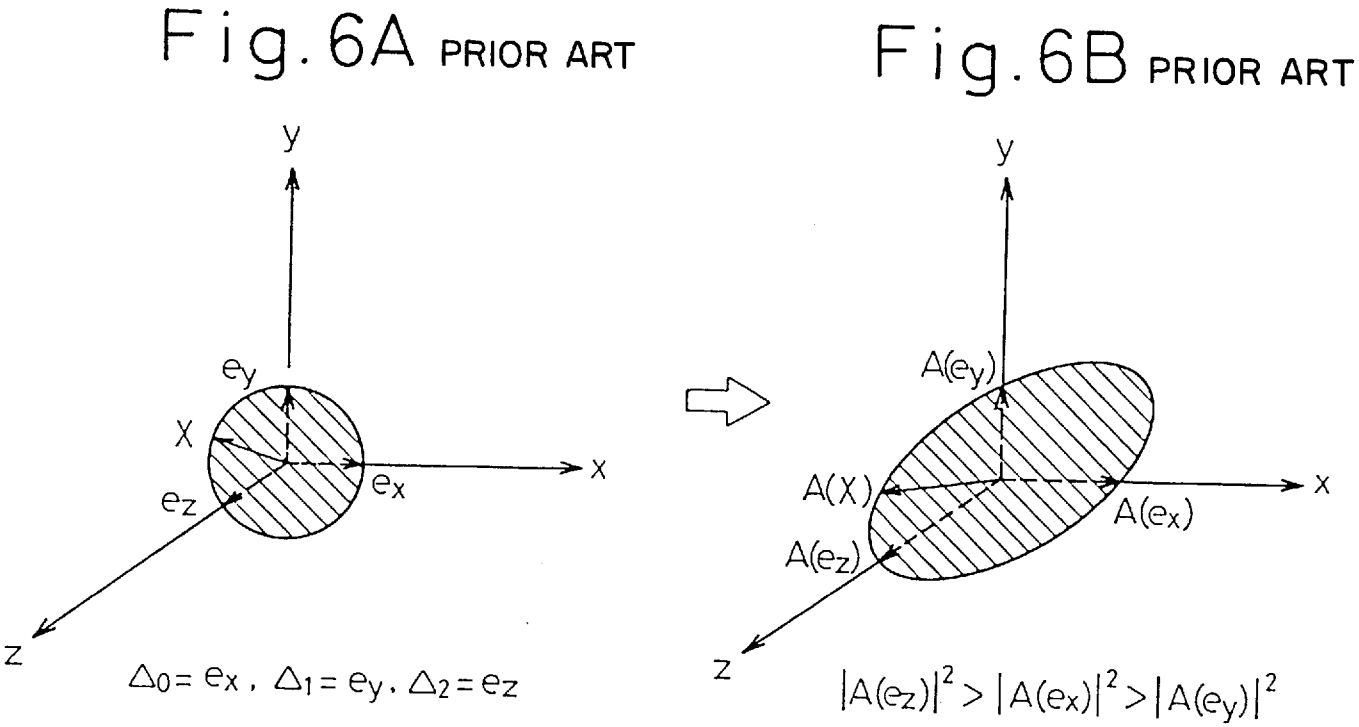
Fig. 6A PRIOR ART
Fig. 6B PRIOR ART
FIGS. 6A and 6B are diagrams for explaining a method of adaptation of a tree-structure code book.

Therefore, as shown in FIGS. 6A and 6B, a residual signal space (the sphere shown in FIG. 6A for L=3) is converted by the linear predictive filter into a reproduced signal space; in general, at this time the directional components of the axes are not uniformly amplified, but are amplified with a certain distortion, as shown in FIG. 6B.

That is, the characteristic (A) of the linear predictive filter exhibits a different amplitude amplification characteristic for each delta vector which is a component element of the code book, and consequently, the resulting vectors are not distributed uniformly throughout the space.

Furthermore, in the tree-structure delta code book shown in FIG. 5, the contribution of each delta vector to code vectors varies depending on the position of the delta vector in the delta code book 10. For example, the delta vector $\Delta_1$ at the second position contributes to all the code vectors at the second and lower levels, and likewise, the delta vector $\Delta_2$ at the third position contributes to all the code vectors at the third and lower levels, whereas the delta vector $\Delta_9$ contributes only to the code vectors at the 10th level. This means that the contribution of each delta vector to the code vectors can be changed by changing the order of the delta vectors.

Noting the above facts, the present applicant has shown, in Japanese Patent Application No. 3-515016, that the characteristic can be improved as compared with the conventional tree-structure code book having a biased distribution, when encoding is performed using a code book constructed in the following manner: each delta vector $\Delta_i$ is processed with the filter characteristic (A), the (amplification ratio of the) power, $|A\Delta_i|^2=(A\Delta_i)^T(A\Delta_i)$, is calculated for the resulting vector $A\Delta_i$ (the power of $A\Delta_i$ is equal to the amplification ratio if the delta vector is normalized), and the delta vectors are reordered in order of decreasing power by comparing the calculated results with each other.

However, in this case also, the number of delta vectors is equal to the number actually used, and encoding is performed using the delta vectors reordered among them. This therefore places a constraint on the freedom of the code book.

Figure 7A:
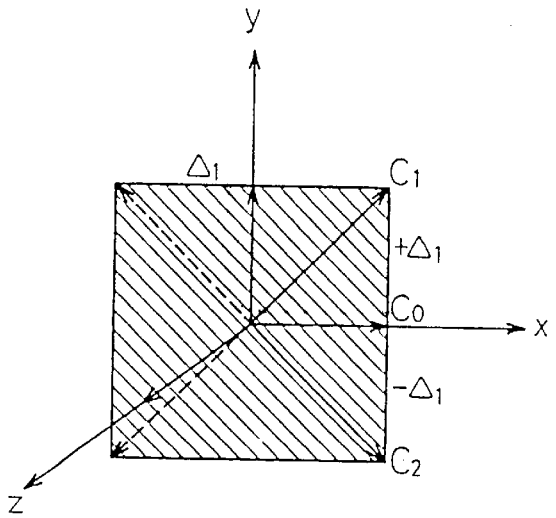
FIGS. 7A, 7B, and 7C are diagrams for explaining the principles of the present invention.
Figure 7B:
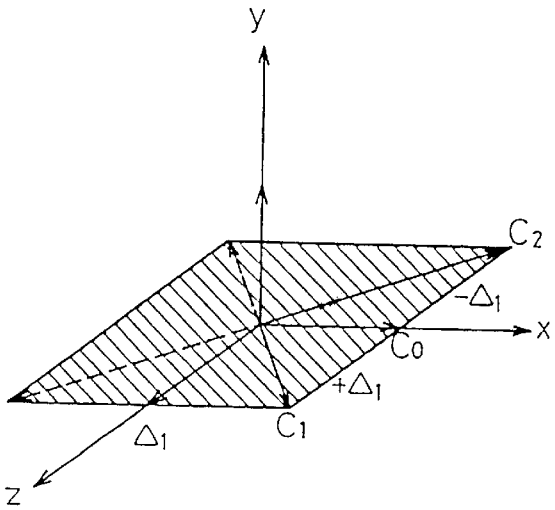
Figure 7C:
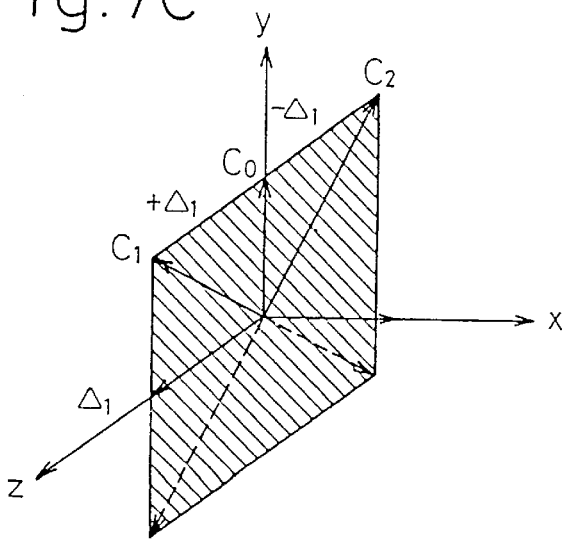

For example, to simplify the discussion, consider the case of L=2, that is, a tree-structure delta code book wherein code vectors $C_0$, $C_1(=\Delta_0+\Delta_1)$, and $C_2(=\Delta_0-\Delta_1)$ are generated from the vector $C_0(=\Delta_0)$ and delta vector $\Delta_1$. If the vectors used as $\Delta_0$ and $\Delta_1$ are limited to unit vectors $e_x$ an $e_y$, as shown in FIG. 7A, the code vectors generated are confined to the x-y plane indicated by oblique hatching even if the order is changed. On the other hand, when two vectors are selected from among three linearly independent unit vectors, $e_x$, $e_y$, and $e_z$, and used as $\Delta_0$ and $\Delta_1$, greater freedom is allowed for the selection of a subspace, as shown in FIGS. 7A to 7C.

Improvement of the Tree-Structure Delta Code Book

The present invention aims at a further improvement of the delta code book, which is achieved as follows. L' delta vector candidates (L'>L), larger in number than L delta vectors (L vectors=initial vector+(L−1) delta vectors) actually used for the construction of the code book, are provided, and these candidates are reordered by performing the same operation as described above, from which candidates the desired number of delta vectors (L delta vectors) are selected in order of decreasing amplification ratio to construct the code book. The code book thus constructed provides greater freedom and contributes to improving the quantization characteristic.

The above description has dealt with the encoder, but in the matching decoder also, the same delta vector candidates as in the encoding side are provided and the same control is performed in the decoder so that a code book of the same contents as in the encoder is constructed, thereby maintaining the matching with the encoder.

Figure 8:
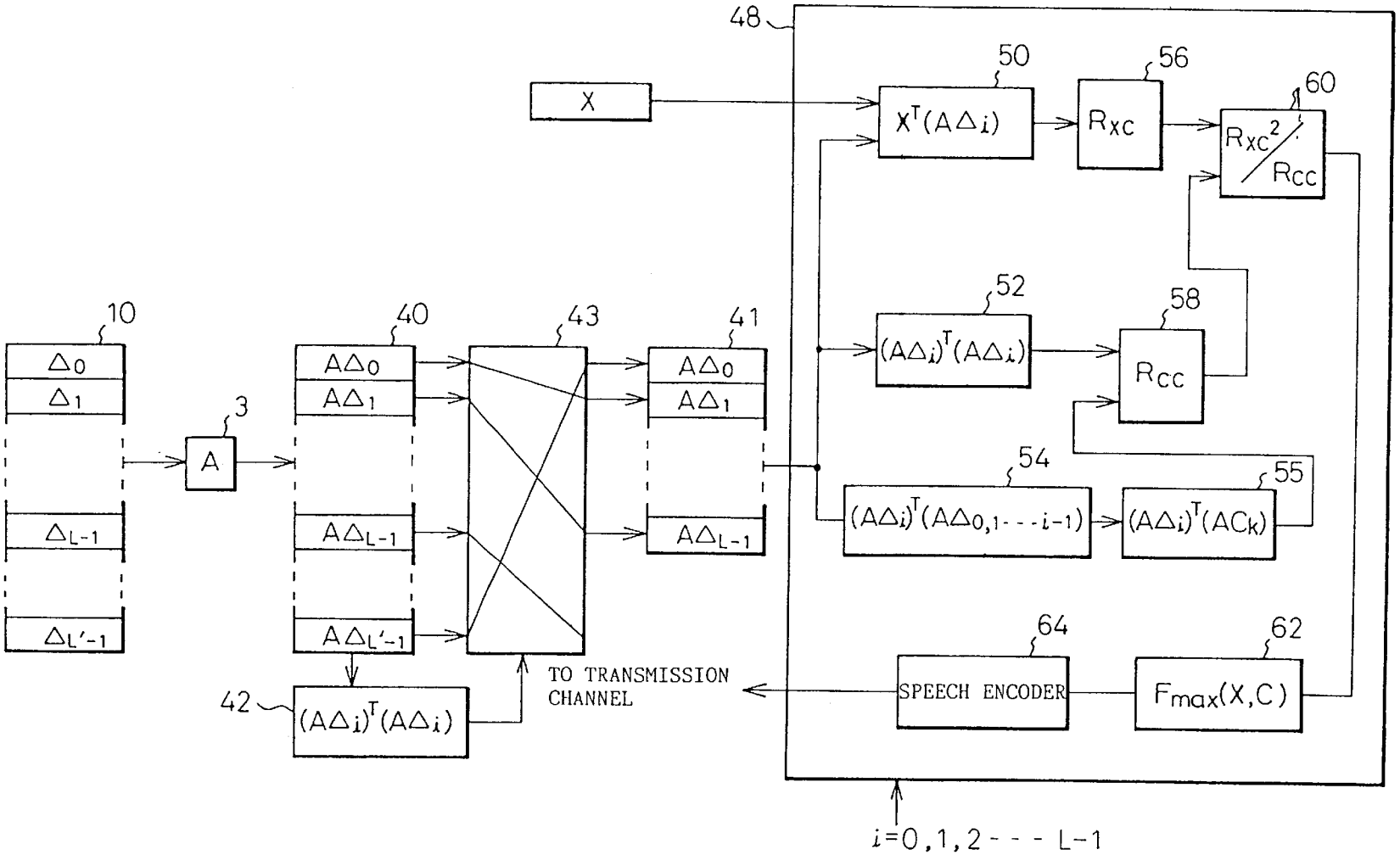
FIG. 8 is a block diagram of a speech encoding apparatus according to the present invention.

FIG. 8 is a block diagram showing one embodiment of a speech encoding method according to the present invention based on the above concept. In this embodiment, the delta vector code book 10 is constructed to store and hold an initial vector $C_0$ $(=\Delta_0)$ representing one reference noise train and delta vectors $\Delta_1-\Delta_{L'-1}$ representing (L'−1)

N-dimensional delta noise trains larger in number than the actually used (L−1). The initial vector $C_0$ and the delta vectors $\Delta_1-\Delta_{L'-1}$ are each defined in N dimensions. That is, the initial vectors and the delta vectors are N-dimensional vectors formed by encoding the noise amplitudes of N samples generated in time series.

Also, in this embodiment, the linear predictive filter 3 is constructed from an IIR filter of order Np. An N×N rectangular matrix A, generated from the impulse response of this filter, is multiplied by each delta vector $\Delta_i$ to perform filtering A on the delta vector $\Delta_i$, and the resulting vector $A\Delta_i$ is output. The Np coefficients of the IIR filter vary in accordance with the input speech signal, and are determined by a known method. More specifically, since there exists a correlation between adjacent samples of the input speech signal, a correlation coefficient between samples is obtained, from which a partial autocorrelation coefficient, known as PARCOR coefficient, is obtained; then, from this PARCOR coefficient, an alpha coefficient of the IIR filter is determined, and using the impulse response train of the filter, an N×N rectangular matrix A is formed to perform filtering on each vector $\Delta_i$.

The L' vectors $A\Delta_i$ (i=0, 1, . . . , L'−1) thus filtered are stored in a memory 40, and the power, $|A\Delta_i|^2=(A\Delta_i)^T(A\Delta_i)$, is evaluated in a power evaluator 42. Since each delta vector is normalized ($|\Delta_i|^2=(\Delta_i)^T(\Delta_i)=1$), the degree of amplification through the filtering A is directly evaluated by just evaluating the power. Next, based on the evaluation results supplied from the power evaluator 42, the vectors are reordered in a sorting section 43 in order of decreasing power. In the example of FIG. 6B, the vectors are reordered as follows.

$$\Delta_0=e_z,\ \Delta_1=e_x,\ \Delta_2=e_y$$

The thus reordered vectors $A\Delta_i$ (i=0, 1, . . . , L'−1) total L' in number, but the subsequent encoding process is performed using the actually used L vectors $A\Delta_i$ (i=0, 1, . . . , L−1).

Therefore, L vectors are selected in order of decreasing amplification ratio and stored in a selection memory 41. In the above example, $\Delta_0=e_z$ and $\Delta_1=e_x$ are selected from among the above delta vectors. Then, using the tree-structure delta code book constructed from these selected vectors, the encoding process is performed in exactly the same manner as previously described for the conventional tree-structure delta code book.

Details of the Encoding Process

The following describes in detail an encoder 48 that determines the index of the code vector C that is closest in distance to the input signal vector X from the input signal vector X and the tree-structure code book consisting of the vectors, $A\Delta_0, A\Delta_1, A\Delta_2, \ldots, A\Delta_{L-1}$, stored in the selection memory 41.

The encoder 48 comprises: a calculator 50 for calculating the cross-correlation, $X^T(A\Delta_i)$, between the input signal vector X and each delta vector $\Delta_i$; a calculator 52 for calculating the autocorrelation, $(A\Delta_i)^T(A\Delta_i)$, of each delta vector $\Delta_i$; a calculator 54 for calculating the cross-correlation, $(A\Delta_i)^T(A\Delta_{0,1,2,\ldots,i-1})$, between each delta vector; a calculator 55 for calculating the orthogonal term $(A\Delta_i)^T(AC_k)$ from the output of the calculator 54; a calculator 56 for accumulating the cross-correlation of each delta vector from the calculator 50 and calculating the cross-correlation $R_{XC}$ between the input signal vector X and each code vector C; a calculator 58 for accumulating the autocorrelation, $(A\Delta_i)^T(A\Delta_i)$, of each delta vector $\Delta_i$ fed from the calculator 52 and each orthogonal term $(A\Delta_i)^T(AC_k)$ fed from the calculator 55, and calculating the autocorrelation of each code vector C; a calculator 60 for calculating $R_{CX}^2/R_{CC}$; a smallest-error noise train determining device 62; and a speech encoder 64.

First, parameter i indicating the tree-structure level under calculation is set to 0. In this state, the calculators 50 and 52 calculate $X^T(A\Delta_0)$ and $(A\Delta_0)^T(A\Delta_0)$, respectively, which are output. The calculators 54 and 55 output 0. $X^T(A\Delta_0)$ and $(A\Delta_0)^T(A\Delta_0)$ output from the calculators 50 and 52, respectively, are stored in the calculators 56 and 58 as the cross-correlation $R_{XC}^{(0)}$ and autocorrelation $R_{CC}^{(0)}$, respectively, which are output. From the $R_{XC}^{(0)}$ and $R_{CC}^{(0)}$, the calculator 60 calculates the value of $F(X, C)=R_{XC}^2/R_{CC}$ which is output.

The smallest-error noise train determining device 62 compares the thus calculated F(X, C) with the maximum value Fmax (initial value 0) of previous F(X, C); if F(X, C)>Fmax, Fmax is updated by taking F(X, C) as Fmax, and at the same time, the previous code is updated by a code that specifies the noise train (code vector) providing the Fmax.

Next, the parameter i is updated from 0 to 1. In this state, the calculators 50 and 52 calculate $X^T(A\Delta_1)$ and $(A\Delta_1)^T(A\Delta_1)$, respectively, which are output. The calculator 54 calculates $(A\Delta_1)^T(A\Delta_0)$, which is output. The calculator 55 outputs the input value as the orthogonal term $(A\Delta_1)^T(AC_0)$. From the stored $R_{XC}^{(0)}$ and the value of $X^T(A\Delta_1)$ output from the calculator 50, the calculator 56 calculates the values of the cross-correlations $R_{XC}^{(1)}$ and $R_{XC}^{(2)}$ at the second level in accordance with Equation (10) or (11); the calculated values are output and stored. From the stored $R_{CC}^{(0)}$ and the values of $(A\Delta_1)^T(A\Delta_1)$ and $(A\Delta_1)^T(AC_0)$ respectively output from the calculators 52 and 55, the calculator 58 calculates the values of the autocorrelations $R_{CC}^{(1)}$ and $R_{CC}^{(2)}$ at the second level in accordance with Equation (12) or (13); the values are output and stored. The operation of the calculator 60 and smallest-error noise train determining device 62 is the same as when i=0.

Next, the parameter i is updated from 1 to 2. In this state, the calculators 50 and 52 calculate $X^T(A\Delta_2)$ and $(A\Delta_2)^T(A\Delta_2)$, respectively, which are output. The calculator 54 calculates the cross-correlations, $(A\Delta_2)^T(A\Delta_1)$ and $(A\Delta_2)^T(A\Delta_0)$, of $\Delta_2$ relative to $\Delta_1$ and $\Delta_0$, respectively. From these values, the calculator 55 calculates the orthogonal term $(A\Delta_2)^T(AC_1)$ in accordance with Equation (14), and outputs the result. From the stored $R_{XC}^{(1)}$ and $R_{XC}^{(2)}$ and the value of $X^T(A\Delta_2)$ fed from the calculator 50, the calculator 56 calculates the values of the cross-correlations $R_{XC}^{(3\text{-}6)}$ at the third level in accordance with Equations (10) or (11); the calculated values are output and stored. From the stored $R_{CC}^{(1)}$ and $R_{CC}^{(2)}$ and the values of $(A\Delta_2)^T(A\Delta_2)$ and $(A\Delta_2)^T(AC_1)$ respectively output from the calculators 52 and 55, the calculator 58 calculates the values of the autocorrelations $R_C^{(3\text{-}6)}$ at the third level in accordance with Equation (12) or (13); the calculated values are output and stored. The operation of the calculator 60 and smallest-error noise train determining device 62 is the same as when i=0 or 1.

The above process is repeated until the processing for i=L−1 is completed, upon which the speech encoder 64 outputs the latest code stored in the smallest-error noise train determining device 62 as the index of the code vector that is closest in distance to the input signal vector X.

When calculating $(A\Delta_i)^T(A\Delta_i)$ in the calculator 52, the calculation result from the power evaluator 42 can be used directly.

Variable Rate Encoding

Using the previously described tree-structure delta code book or the tree-structure delta code book improved by the present invention, variable rate encoding can be realized that does not require as much memory as is required for the conventional code book and is capable of coping with bit drop situations.

Figure 9A:
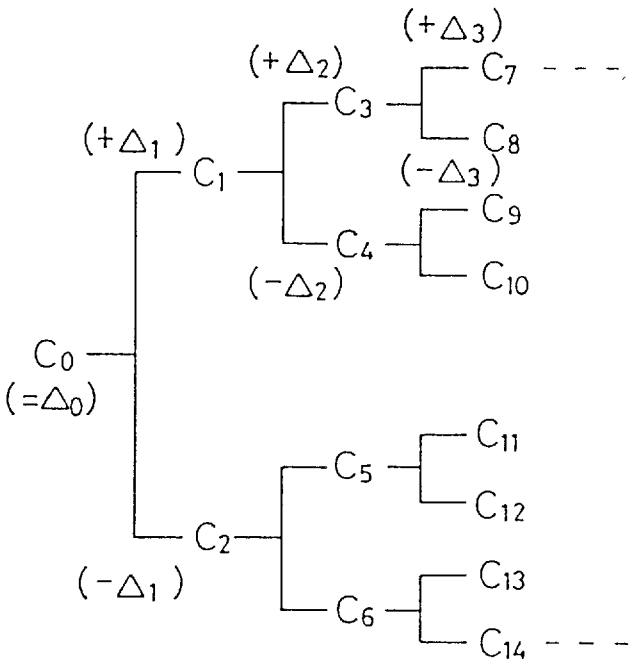
FIGS. 9A and 9B are diagrams for explaining a variable rate encoding method according to the present invention.

That is, a tree-structure delta code book, having the structure shown in FIG. 9A consisting of $\Delta_0, \Delta_1, \Delta_2, \ldots$, is stored. If, of these vectors, encoding is performed using only the vector $\Delta_0$ at the first level so that two code vectors $C_*=0$ (Zero vector)

Figure 9B:
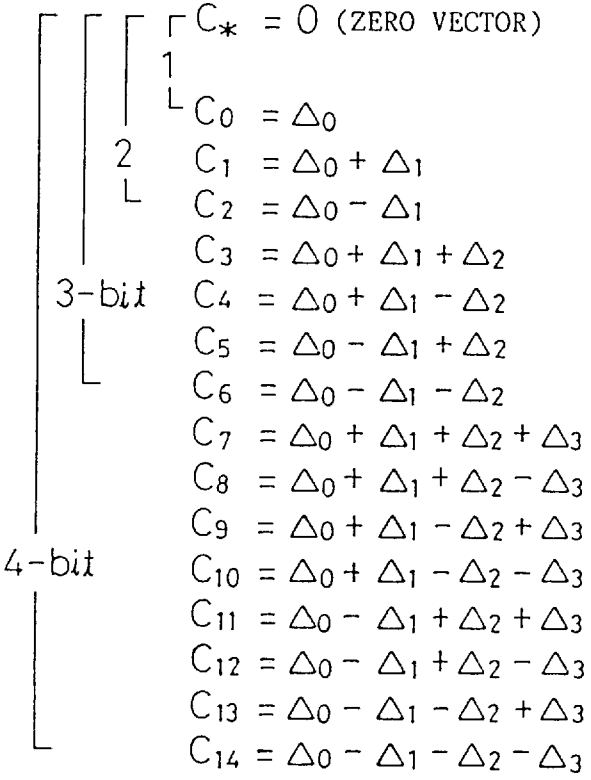

$C_0=\Delta_0$ are generated, as shown in FIG. 9B, then one-bit encoding is accomplished with one-bit information indicating whether to select or not select $C_0$ as the index data.

If encoding is performed using the vectors $\Delta_0$ and $\Delta_1$ down to the second level so that four code vectors $C_*=0$ $C_0=\Delta_0$ $C_1=\Delta_0+\Delta_1$ $C_2=\Delta_0-\Delta_1$ are generated, then two-bit encoding is accomplished with two-bit information, one bit indicating whether $C_0$ is selected as the index data and the other specifying $\Delta C_1$ or $-\Delta C_1$.

Likewise, using vectors $\Delta_0, \Delta_1, \ldots, \Delta_i$ down to the ith level, i-bit encoding can be accomplished. Accordingly, by using one tree-structure delta code book containing $\Delta_0, \Delta_1, \ldots, \Delta_{L-1}$, the bit length of the generated index data can be varied as desired within the range of 1 to L.

If variable bit rate encoding with 1 to L bits is to be realized using the conventional code book, the number of words in the required memory will be $$N\times(2^0+2^1+\ldots+2^L)=N\times(2^{L+1}-1)$$

where N is the vector dimension. By contrast, if the tree-structure delta code book of FIG. 9A is used as shown in FIG. 9B, the number of words in the required memory will be $$N\times L$$

Either the previously described tree-structure delta code book wherein the vectors are not reordered, the tree-structure delta code book wherein the delta vectors are reordered according to the amplification ratio by A, or the tree-structure delta code book wherein L data vectors are selected for use from among L' delta vectors, may be used to realize the tree-structure delta code book described above.

Variable bit rate control can be easily accomplished by stopping the processing in the encoder 48 at the desired level corresponding to the desired bit length. For example, for four-bit encoding, the encoder 48 should be controlled to perform the above-described processing for i=0, 1, 2, and 3.

Embedded Encoding

Embedded encoding is an encoding scheme capable of reproducing voice at the decoder even if part of bits are dropped along the transmission channel. In variable rate encoding using the above tree-structure delta code book, this can be accomplished by constructing the encoding system so that if any bit is dropped, the affected code vector can be reproduced as the code vector of its parent or ancestor in the tree structure. For example, in a four-bit encoding system $[C_0, C_1, \ldots, C_{14}]$, if one bit is dropped, $C_{13}$ and $C_{14}$ are reproduced as $C_6$ in a three-bit code and $C_{12}$ and $C_{11}$ as $C_5$ in a three-bit code. In this manner, speech sound can be reproduced without significant degradation in sound quality since code vectors having a parent-child relationship have relatively close values.

Tables 1 to 4 show an example of such an encoding scheme.

TABLE 1 transmitted bits: 1 bit

| code vector | transmitted code |
|---|---|
| $C_*$ | 0 |
| $C_0$ | 1 |

TABLE 2 transmitted bits: 2 bit

| code vector | transmitted code |
|---|---|
| $C_*$ | 00 |
| $C_0$ | 01 |
| $C_1$ | 11 |
| $C_2$ | 10 |

TABLE 3 transmitted bits: 3 bit

| code vector | transmitted code |
|---|---|
| $C_*$ | 000 |
| $C_0$ | 001 |
| $C_1$ | 011 |
| $C_2$ | 010 |
| $C_3$ | 111 |
| $C_4$ | 110 |
| $C_5$ | 101 |
| $C_6$ | 100 |

TABLE 4 transmitted bits: 4 bit

| code vector | transmitted code |
|---|---|
| $C_*$ | 0000 |
| $C_0$ | 0001 |
| $C_1$ | 0011 |
| $C_2$ | 0010 |
| $C_3$ | 0111 |
| $C_4$ | 0110 |
| $C_5$ | 0101 |
| $C_6$ | 0100 |
| $C_7$ | 1111 |
| $C_8$ | 1110 |
| $C_9$ | 1101 |
| $C_{10}$ | 1100 |
| $C_{11}$ | 1011 |
| $C_{12}$ | 1010 |
| $C_{13}$ | 1001 |
| $C_{14}$ | 1000 |

In the case of 4 bits, for example, the above encoding scheme is set as follows.

$C_{11}=\Delta_0-\Delta_1+\Delta_2+\Delta_3$ has four delta vector elements whose signs are (+, −, +, +) in decreasing order of significance, and is therefore expressed as "11011".

$C_2=\Delta_0-\Delta_1$ has only two delta vector elements whose signs are (+, −) in this order. The code in this case is assumed equivalent to (0, 0, +, −) and expressed as "0010".

Table 5 shows how the thus encoded information is reproduced when a one-bit drop has occurred, reducing 4 bits to 3 bits.

TABLE 5

| encode (4 bits) | | transmission channel (bit drop) | decode (3 bits) | |
|---|---|---|---|---|
| $C_\cdot$ | 0000 | 0000 → 000 | 000 | $C_\cdot$ |
| $C_0$ | 0001 | 0001 → 000 | 000 | $C_\cdot$ |
| $C_1$ | 0011 | 0011 → 001 | 001 | $C_0$ |
| $C_2$ | 0010 | 0010 → 001 | 001 | $C_0$ |
| $C_3$ | 0111 | 0111 → 011 | 011 | $C_1$ |
| $C_4$ | 0110 | 0110 → 011 | 011 | $C_1$ |
| $C_5$ | 0101 | 0101 → 010 | 010 | $C_2$ |
| $C_6$ | 0100 | 0100 → 010 | 010 | $C_2$ |
| $C_7$ | 1111 | 1111 → 111 | 111 | $C_3$ |
| $C_8$ | 1110 | 1110 → 111 | 111 | $C_3$ |
| $C_9$ | 1101 | 1101 → 110 | 110 | $C_4$ |
| $C_{10}$ | 1100 | 1100 → 110 | 110 | $C_4$ |
| $C_{11}$ | 1011 | 1011 → 101 | 101 | $C_5$ |
| $C_{12}$ | 1010 | 1010 → 101 | 101 | $C_5$ |
| $C_{13}$ | 1001 | 1001 → 100 | 100 | $C_6$ |
| $C_{14}$ | 1000 | 1000 → 100 | 100 | $C_6$ |

As can be seen from Table 5 in conjunction with FIG. 9A, when a one-bit drop occurs, the affected code is reproduced as the vector one level upward.

When two bits are dropped, the code is reconstructed as shown in Table 6.

TABLE 6

| encode (4 bits) | | transmission channel (bit drop) | decode (2 bits) | |
|---|---|---|---|---|
| $C_\cdot$ | 0000 | 0000 → 00 | 00 | $C_\cdot$ |
| $C_0$ | 0001 | 0001 → 00 | 00 | $C_\cdot$ |
| $C_1$ | 0011 | 0011 → 00 | 00 | $C_\cdot$ |
| $C_2$ | 0010 | 0010 → 00 | 00 | $C_\cdot$ |
| $C_3$ | 0111 | 0111 → 01 | 01 | $C_0$ |
| $C_4$ | 0110 | 0110 → 01 | 01 | $C_0$ |
| $C_5$ | 0101 | 0101 → 01 | 01 | $C_0$ |
| $C_6$ | 0100 | 0100 → 01 | 01 | $C_0$ |
| $C_7$ | 1111 | 1111 → 11 | 11 | $C_1$ |
| $C_8$ | 1110 | 1110 → 11 | 11 | $C_1$ |
| $C_9$ | 1101 | 1101 → 11 | 11 | $C_1$ |
| $C_{10}$ | 1100 | 1100 → 11 | 11 | $C_1$ |
| $C_{11}$ | 1011 | 1011 → 10 | 10 | $C_2$ |
| $C_{12}$ | 1010 | 1010 → 10 | 10 | $C_2$ |
| $C_{13}$ | 1001 | 1001 → 10 | 10 | $C_2$ |
| $C_{14}$ | 1000 | 1000 → 10 | 10 | $C_2$ |

In this case, the affected code is reproduced as the vector of its ancestor two levels upward.

Tables 7 to 10 show another example of the embedded encoding scheme of the present invention.

TABLE 7

| transmitted bits: 1 bit | |
|---|---|
| code vector | transmitted code |
| $C_\cdot$ | 0 |
| $C_0$ | 1 |

TABLE 8

| transmitted bits: 2 bit | |
|---|---|
| code vector | transmitted code |
| $C_\cdot$ | 00 |
| $C_0$ | 01 |
| $C_1$ | 10 |
| $C_2$ | 11 |

TABLE 9

| transmitted bits: 3 bit | |
|---|---|
| code vector | transmitted code |
| $C_\cdot$ | 000 |
| $C_0$ | 001 |
| $C_1$ | 010 |
| $C_2$ | 011 |
| $C_3$ | 100 |
| $C_4$ | 101 |
| $C_5$ | 110 |
| $C_6$ | 111 |

TABLE 10

| transmitted bits: 4 bit | |
|---|---|
| code vector | transmitted code |
| $C_\cdot$ | 0000 |
| $C_0$ | 0001 |
| $C_1$ | 0010 |
| $C_2$ | 0011 |
| $C_3$ | 0100 |
| $C_4$ | 0101 |
| $C_5$ | 0110 |
| $C_6$ | 0111 |
| $C_7$ | 1000 |
| $C_8$ | 1001 |
| $C_9$ | 1010 |
| $C_{10}$ | 1011 |
| $C_{11}$ | 1100 |
| $C_{12}$ | 1101 |
| $C_{13}$ | 1110 |
| $C_{14}$ | 1111 |

In this encoding scheme also, when one bit is dropped, the parent vector of the affected vector is substituted, and when two bits are dropped, the ancestor vector two levels upward is substituted.

We claim:

1. A speech encoding method by which an input speech signal vector is encoded using an index assigned to a code vector that, among predetermined code vectors, is closest in distance to said input speech signal vector, comprising the steps of:

a) storing a plurality of differential code vectors having a tree structure;

b) multiplying each of said differential code vectors by a matrix of a linear predictive filter;

c) evaluating a power amplification ratio of each differential code vector multiplied by said matrix;

d) reordering the differential code vectors, each multiplied by said matrix, in decreasing order of said evaluated power amplification ratio;

e) selecting from among said reordered vectors a prescribed number of vectors in decreasing order of said evaluated power amplification ratio, the largest ratio first the number of the selected vectors being smaller than a number of the reordered vectors;

f) evaluating the distance between said input speech signal vector and each of linear-predictive-filtered code vectors that are to be formed by sequentially adding and subtracting said selected vectors through the tree structure; and g) determining the code vector for which said evaluated distance is the smallest.

2. A method according to claim 1, wherein each of said differential code vectors is normalized.

3. A method according to claim 1, wherein said step f) includes: calculating a cross-correlation $R_{XC}$ between said input speech signal vector and each of said linear-predictive- filtered code vectors by calculating the cross-correlation between said input speech signal vector and each of said selected vectors and by sequentially performing additions and subtractions through the tree structure; calculating an autocorrelation $R_{CC}$ of each of said linear-predictive- filtered code vectors by calculating the autocorrelation of each of said selected vectors and the cross-correlation of every possible combination of different vectors and by sequentially performing additions and subtractions through the tree structure; and calculating the quotient of a square of the cross-correlation $R_{XC}$ by the autocorrelation $R_{CC}$, $R_{XC}^2/R_{CC}$, for each of said code vectors, and said step g) includes determining the code vector that maximizes the value of $R_{XC}^2/R_{CC}$, as the code vector that is closest in distance to said input speech signal vector.

4. A speech encoding apparatus by which an input speech signal vector is encoded using an index assigned to a code vector that, among predetermined code vectors, is closest in distance to said input speech signal vector, comprising:

means for storing a plurality of differential code vectors having a tree structure;

means for multiplying each of said differential code vectors by a matrix of a linear predictive filter;

means for evaluating a power amplification ratio of each differential code vector multiplied by said matrix;

means for reordering the differential code vectors, each multiplied by said matrix, in decreasing order of said evaluated power amplification ratio;

means for selecting from among said reordered vectors a prescribed number of vectors in decreasing order of said evaluated power amplification ratio, the largest ratio first, the number of the selected vectors being smaller than a number of the reordered vectors;

means for evaluating the distance between said input speech signal vector and each of linear-predictive-filtered code vectors that are to be formed by sequentially adding and subtracting said selected vectors through the tree structure; and means for determining the code vector for which said evaluated distance is the smallest.

5. An apparatus according to claim 4, wherein each of said differential code vectors is normalized.

6. An apparatus according to claim 4, wherein said distance evaluation means includes: means for calculating a cross-correlation $R_{XC}$ between said input speech signal vector and each of said linear-predictive-filtered code vectors by calculating the cross-correlation between said input speech signal vector and each of said selected vectors and by sequentially performing additions and subtractions through the tree structure; means for calculating an autocorrelation $R_{CC}$ of each of said linear-predictive- filtered code vectors by calculating the autocorrelation of each of said selected vectors and the cross-correlation of every possible combination of different vectors and by sequentially performing additions and subtractions through the tree structure; and means for calculating the quotient of a square of the cross-correlation $R_{XC}$ by the autocorrelation $R_{CC}$, $R_{XC}^2/R_{CC}$, for each of said code vectors, and said code vector determining means includes means for determining the code vector that maximizes the value of $R_{XC}^2/R_{CC}$, as the code vector that is closest in distance to said input speech signal vector.

7. A variable-length speech encoding method by which an input speech signal vector is variable-length encoded using a variable-length code assigned to a code vector that, among predetermined code vectors, is closest in distance to said input speech signal vector, comprising the steps of:

a) storing a plurality of differential code vectors having a tree structure;

b) evaluating a distance between said input speech signal vector and each of code vectors that are to be formed by sequentially performing additions and subtractions with regard to differential code vectors the number of which corresponds to a variable code length, working from a root of the tree structure;

c) determining a code vector for which said evaluated distance is the smallest; and d) determining a code, of the variable code length, to be assigned to said determined code vector.

8. A method according to claim 7, further comprising the step of multiplying each of said differential code vectors by a matrix in a linear predictive filter, wherein in said step b) the distance is evaluated between said input speech signal vector and each of linear-predictive- filtered code vectors that are to be formed by sequentially adding and subtracting the differential code vectors, each multiplied by said matrix, through the tree structure.

9. A method according to claim 8, wherein said step b) includes: calculating a cross-correlation $R_{XC}$ between said input speech signal vector and each of said linear-predictive- filtered code vectors by calculating the cross-correlation between said input speech signal vector and each of said differential code vectors multiplied by said matrix and by sequentially performing additions and subtractions through the tree structure; calculating an autocorrelation $R_{CC}$ of each of said linear-predictive- filtered code vectors by calculating the autocorrelation of each of said differential code vectors multiplied by said matrix and the cross-correlation of every possible combination of different vectors and by sequentially performing additions and subtractions through the tree structure; and calculating the quotient of a square of the cross-correlation $R_{XC}$ by the autocorrelation $R_{CC}$, $R_{XC}^2/R_{CC}$, for each of said code vectors, and said step c) includes determining the code vector that maximizes the value of $R_{XC}^2/R_{CC}$, as the code vector that is closest in distance to said input speech signal vector.

10. A method according to claim 9, further comprising the steps of:

evaluating a power amplification ratio of each differential code vector multiplied by said matrix; and reordering the differential code vectors, each multiplied by said matrix, in decreasing order of said evaluated power amplification ratio;

wherein in said step b) the additions and subtractions are performed in the thus reordered sequence through the tree structure.

11. A method according to claim 10, further comprising the step of selecting from among said reordered vectors a prescribed number of vectors in decreasing order of said evaluated power amplification ratio, the largest ratio first, wherein in said step b) the additions and subtractions are performed on said selected vectors through the tree structure.

12. A method according to claim 7, wherein a code is assigned to said code vector in such a manner as to be associated with a code vector corresponding to the parent thereof in the tree structure when one bit is dropped from any of said code vectors.

13. A variable-length speech encoding apparatus by which an input speech signal vector is variable-length encoded using a variable-length code assigned to a code vector that, among predetermined code vectors, is closest in distance to said input speech signal vector, comprising:

means for storing a plurality of differential code vectors having a tree structure;

means for evaluating a distance between said input speech signal vector and each of the code vectors that are to be formed by sequentially performing additions and subtractions with regard to differential code vectors the number of which corresponds to a variable code length, working from a root of the tree structure;

means for determining a code vector for which said evaluated distance is the smallest; and means for determining a code, of the variable code length, to be assigned to said determined code vector.

14. An apparatus according to claim 13, further comprising means for multiplying each of said differential code vectors by a matrix in a linear predictive filter, wherein said distance evaluating means evaluates the distance between said input speech signal vector and each of linear-predictive-filtered code vectors that are to be formed by sequentially adding and subtracting the differential code vectors, each multiplied by said matrix, through the tree structure.

15. An apparatus according to claim 14, wherein said distance evaluating means includes: means for calculating a cross-correlation $R_{XC}$ between said input speech signal vector and each of said linear-predictive-filtered code vectors by calculating the cross-correlation between said input speech signal vector and each of said differential code vectors multiplied by said matrix and by sequentially performing additions and subtractions through the tree structure; means for calculating an autocorrelation $R_{CC}$ of each of said linear-predictive- filtered code vectors by calculating the autocorrelation of each of said differential code vectors multiplied by said matrix and the cross-correlation of every possible combination of different vectors and by sequentially performing additions and subtractions through the tree structure; and means for calculating the quotient of a square of the cross-correlation $R_{XC}$ by the autocorrelation $R_{CC}$, $R_{XC}^2/R_{CC}$, for each of said code vectors, and said code vector determining means includes means for determining the code vector that maximizes the value of $R_{XC}^2/R_{CC}$, as the code vector that is closest in distance to said input speech signal vector.

16. An apparatus according to claim 15, further comprising:

means for evaluating a power amplification ratio of each differential code vector multiplied by said matrix; and means for reordering the differential code vectors, each multiplied by said matrix, in decreasing order of said evaluated power amplification ratio;

wherein said distance evaluating means performs the additions and subtractions in the thus reordered sequence through the tree structure.

17. An apparatus according to claim 15, further comprising means for selecting from among said reordered vectors a prescribed number of vectors in decreasing order of said evaluated power amplification ratio, the largest ratio first, wherein said distance evaluating means performs the additions and subtractions on said selected vectors through the tree structure.

18. An apparatus according to claim 13, wherein a code is assigned to said code vector in such a manner as to be associated with a code vector corresponding to a parent thereof in the tree structure when one bit is dropped from any of said code vectors.

* * * * *

UNITED STATES PATENT AND TRADEMARK OFFICE

CERTIFICATE OF CORRECTION

PATENT NO. : 5,864,650
DATED : January 26, 1999
INVENTOR(S) : Tomohiko TANIGUCHI et al.

It is certified that error appears in the above-identified patent and that said Letters Patent is hereby corrected as shown below:

On the title page, in [57] Abstract,
line 3, delete "(3)";
line 4, delete "(42)";
line 5, delete "(43)";
line 7, delete "(41)";
line 8, delete "(48)".

Col. 8, line 6, change "L-N" to --L·N--.

Col. 12, line 53, change "$R_C^{(3-6)}$" to --$R_{CC}^{(3-6)}$--.

Col. 14, line 64, change "11011" to --1011--.

Signed and Sealed this
Seventeenth Day of August, 1999

*Attest:*

Q. TODD DICKINSON

*Attesting Officer*

*Acting Commissioner of Patents and Trademarks*